United States Patent [19]

Coggin, Jr.

[11] 4,076,181

[45] Feb. 28, 1978

[54] PRECISION WINDER FOR DRAWING AND PACKAGING SYNTHETIC FIBERS

[75] Inventor: Charles H. Coggin, Jr., Glendora, Calif.

[73] Assignee: Kaiser Glass Fiber Corporation, Oakland, Calif.

[21] Appl. No.: 735,000

[22] Filed: Oct. 22, 1976

[51] Int. Cl.[2] ..... B63H 54/02

[52] U.S. Cl. ..... 242/18 G; 242/18 R; 242/43 R

[58] Field of Search ..... 242/18 G, 18 R, 18 CS, 242/43 R, 43 A, 45; 65/2, 11 W

[56] References Cited

U.S. PATENT DOCUMENTS

| | | | |
|---|---|---|---|
| 3,273,985 | 9/1966 | Small | 242/18 R |
| 3,695,523 | 10/1972 | Genson | 242/18 R |
| 3,784,121 | 1/1974 | Arno | 242/18 G |
| 3,819,122 | 6/1974 | Genson | 242/18 G |

*Primary Examiner*—Edward J. McCarthy

[57] ABSTRACT

A winder for directly drawing glass fibers and the like to form a precision wound package. The winder employs a traverse mounted in a fixed position and a spindle mounted in parallel relationship to the traverse for movement toward and away therefrom in a rectilinear path extending normal to the traverse. A sensor is provided to sense the distance between the traverse and a package of windings on the spindle, and motion imparting means for the spindle is associated with the sensor and the spindle to move the spindle relative to the traverse to maintain a substantially constant distance between the traverse and the package. As a result of the fixed position of the traverse and the constant distance maintained between the package and the traverse, the angle at which fibers are drawn onto the spindle is also maintained constant.

9 Claims, 5 Drawing Figures

PRECISION WINDER FOR DRAWING AND PACKAGING SYNTHETIC FIBERS

BACKGROUND OF THE INVENTION

The present invention relates to the drawing of synthetic fiber, such as glass fiber, and is particularly concerned with a winder which enables such fibers to be directly drawn into a precision package, without the necessity of rewinding rovings. The invention is especially directed to such a winder which is ideally suited for use with high-capacity nontip bushings of the type disclosed in U.S. Pat. No. 3,905,790. Such bushings enable the drawing of sufficiently large quantities of fiber that roving operations may be done away with.

The prior art relating to winders of the type with which the present invention is concerned is believed best exemplified by U.S. Pat. Nos. 3,365,145; 3,367,587; 3,371,877; and 3,897,021. These patents all relate to winders wherein relatively precision shaped packages may be directly wound. The winders shown in the patents employ fixedly mounted spindles having traverses mounted for movement away therefrom in response to the growth of a package on the spindle. As a result of the fixed position of the spindles, the angle at which fibers are drawn onto the spindles varies as the size of the package on the spindle increases.

U.S. Pat. No. 3,249,312 discloses an arrangement for forming a precision roving from a plurality of previously formed primary packages. The roving winder of this patent employs a fixed traverse and a spindle mounted for swinging movement relative to the traverse. The mounting for the spindle comprises an arm, and movement of the arm results from bearing engagement of the traverse with a growing package formed on the spindle.

U.S. Pat. No. 3,801,030 is of interest in that it discloses a textile yarn winding process and machine wherein the bobbin moves relative to a traverse. In the patent, the bobbin is mounted on a pivotally supported arm and, as a result, the bobbin moves in an arc relative to the traverse.

SUMMARY OF THE INVENTION

The winder of the present invention is designed for directly drawing glass fiber from an orifice plate to form a precision wound package. The principal elements of the winder comprise a traverse mounted in a fixed position and a spindle mounted in parallel relationship to the traverse for rectilinear movement toward and away therefrom. A sensor is provided to sense the distance between the traverse and the peripheral surface of a package of windings on the spindle and motion imparting means is coupled to the spindle to move the spindle away from the traverse in response to the sensed distance between the traverse and the package to maintain a substantially constant distance between the peripheral surface of the package and the traverse.

A principal object of the invention is to provide a direct winder wherein the traverse is fixed and wobbling and other undesirable movement of the traverse is avoided.

Another object of the invention is to provide a direct winder wherein a strand being drawn onto the peripheral surface of a package of windings on the spindle is maintained at a substantially constant angle relative to said surface.

Another and more specific object of the invention is to provide a direct winder wherein relative movement between the traverse and spindle of the winder is provided by mounting the spindle for rectilinear movement relative to the traverse.

Still another object of the invention is to provide a direct winder wherein an oscillatory circuit is provided to sense the distance between the spindle and traverse, which oscillatory circuit employs a fixedly mounted oscillator and a movably mounted metallic triggering element carried by the follower of the traverse.

Yet another and more general object of the invention is to provide a winder for directly drawing glass filaments from a bushing, which winder forms a precision package and eliminates the need for subsequent roving operations.

Still another object of the invention is to provide a direct winder which improves the roving quality by eliminating catenary and reducing fiber breakage in rewinding.

A further object of the invention is to provide a a direct winder wherein tension on the strand being wound maintains the traverse guide out of contact with the package being wound.

A further general object of the invention is to provide direct winder for use in a glass fiber drawing operation which improves efficiency of the operation by providing longer runs.

The foregoing and other objects will become more apparent when viewed in light of the following detailed description and accompanying drawings.

BRIEF DESCRIPTION OF THE DRAWINGS

FIG. 2 is an elevational view diagrammatically illustrating the position which the winder assumes relative to a bushing from which fibers are being directly drawn by the spindle of the winder and showing an embodiment wherein the traverse guide contacts the peripheral surface of the package being wound;

FIG. 2A is an elevational view similar to FIG. 2, diagrammatically illustrating the position which the winder assumes relative to a bushing from which fibers are being drawn and showing an embodiment wherein the tension on the strand being wound maintains the traverse guide out of contact with the package being wound;

DESCRIPTION OF THE ILLUSTRATED EMBODIMENT

Figure 1:
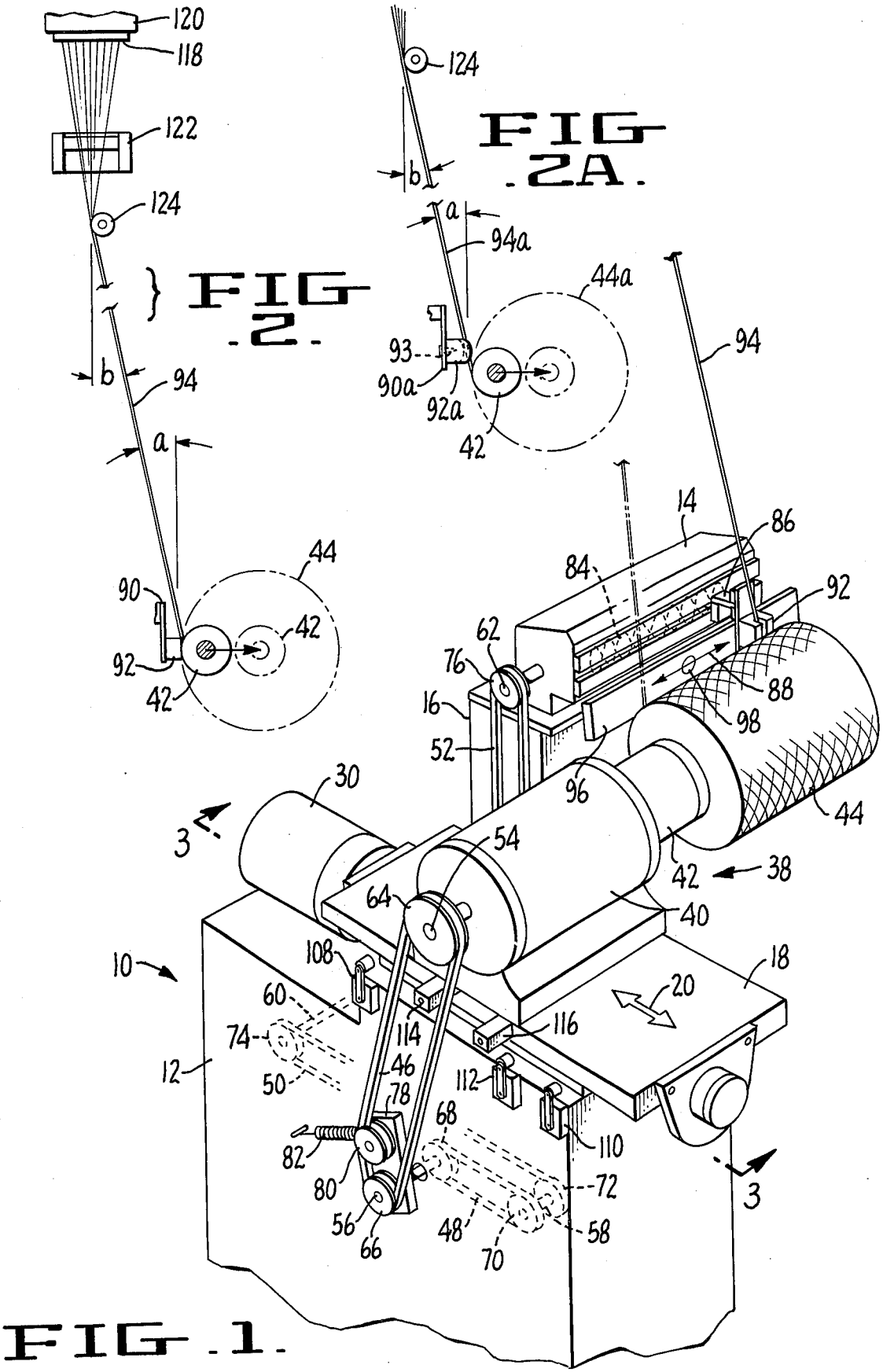
FIG. 1 is a perspective view of the winder of the present invention.
Figure 4:
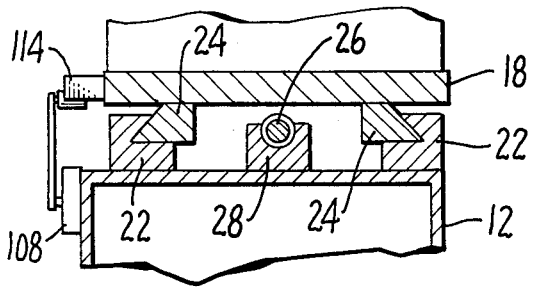

Referring now to FIG. 1, the winder is designated therein in its entirety by the numeral 10. The base element of the winder comprises a pedestal 12 which supports all of the winder structure. A traverse 14 is fixedly mounted to one side of the pedestal 12 through means of an arm 16 forming part of the pedestal and extending to one side thereof. A table 18 is mounted on the pedestal 12 to one side of the arm 16 for slidable movement relative to the pedestal in a rectilinear path extending normal to the traverse 14. The arrow line 20 designates the direction of movement of the table. The guide structure which provides the slidable movement may best be seen from FIG. 4 and comprises grooved rails 22 fixed to the upper side of the pedestal 12 and followers 24 fixed to the underside of the table 18 and slidably engaged within the grooves of the rails 12.

Back and forth movement of the table 18 relative to the pedestal 12 is provided through means of a screw 26 rotatably mounted on and extending longitudinally of the table and a half-nut 28 fixed to the upper side of the pedestal and threadably engaged with the screw. An electric motor 30 is mounted on the table 18 to one end of the screw to selectively impart rotation to the screw, to effect movement of the table. The motor 30 is of the two-speed, reversible type and is selectively coupled to the screw through an electrical clutch 34. During normal running operation, the motor 30 is continuously run at low speed in a direction which would move the table 18 away from the arm 16 and the clutch 34 is selectively engaged to incrementally move the table away from the arm 16. The high-speed, reversible mode of the motor is employed during start-up and shut-down to quickly move the spindle 38 toward and away from the traverse 14.

A spindle 38 is carried by the table 18 and comprises a drive motor 40 fixedly mounted on the upper surface of the table and a collector 42 extending from one side thereof in parallel relationship to the traverse 14. As shown in FIG. 1, the collector of the spindle has a package of windings 44 precision wrapped therearound.

The motor 40 directly drives the collector 42 and, through means of a series of belts, drives the barrel cam of the traverse 14. The belts and the support shafts and sheaves therefor may be seen from FIG. 1 wherein the belts are designated by the numerals 46, 48, 50 and 52; the shafts are designated by the numerals 54, 56, 58, 60 and 62; and, the sheaves are designated by the numerals 64, 66, 68, 70, 72, 74 and 76. The sheaves are fixed to the respective shafts therefor and the shafts are mounted through means of suitable bearings. A belt tensioner 78 is mounted for rotation about the axis of the shaft 56 and carries sheave 80 disposed for engagement with the belt 46. A spring 82 normally biases the sheave 80 against the belt 46.

The traverse 14 is of conventional construction and may be of the type manufactured by Leesona Corporation of Warwick, Rhode Island. It includes a barrel cam 84 driven by the shaft 62 and a follower 86 engaged with the cam for back and forth movement across the traverse in the direction indicated by the arrow line 88. The follower 86 carries a metallic leaf spring 90 which, in turn, carries a guide block 92. The guide block 92 is of notched configuration, as viewed in plan, and designed to guide a roving strand within the notch thereof. Such a roving strand is illustrated in the drawings and designated by the numeral 94. The outside surface of the guide block 92 is positioned for slidable engagement with the collector 42 or a package of rovings wound thereon and, as a result, the block is depressed toward the traverse 14 and against the influence of the spring 90 in response to growth of the package.

The arm 16 carries a plate 96 disposed beneath the traverse 14 in opposition to the spring 90. The plate has an aperture 98 extending through the central portion thereof at a position located centrally of the length of the package 44 and an r.f. oscillator (proximity switch) 100 is mounted to the plate 96 to the rear of an in alignment with the aperture 98. Switches of this type are commercially available, e.g., those manufactured by the Honeywell Micro Switch Division of Honeywell, Inc., and identified as type "FY". The positioning of the aperture and oscillator 100 is such that the leaf spring 90 is normally outside the field of the oscillator, but enters the field upon being depressed to a predetermined degree by a package on the collector 42 and positioned in opposition to the aperture 98. As a result of the latter arrangement, the spring 90 changes the amplitude of the oscillator 100 whenever a package on the collector 42 has grown to an extent decreasing the distance between the package and the traverse 14 to a predetermined degree. Upon reaching the latter condition, the change in the oscillator amplitude is detected and employed to energize the clutch 34 for a predetermined length of time so as to turn the screw 26 and move the spindle away from the traverse by a predetermined increment. This adjustment operation takes place during the normal low-speed operation of the motor 30 and is repeated successively as a package grows and, as a result, the distance between the peripheral surface of the package and the traverse 14 is maintained substantially constant.

Figure 3:
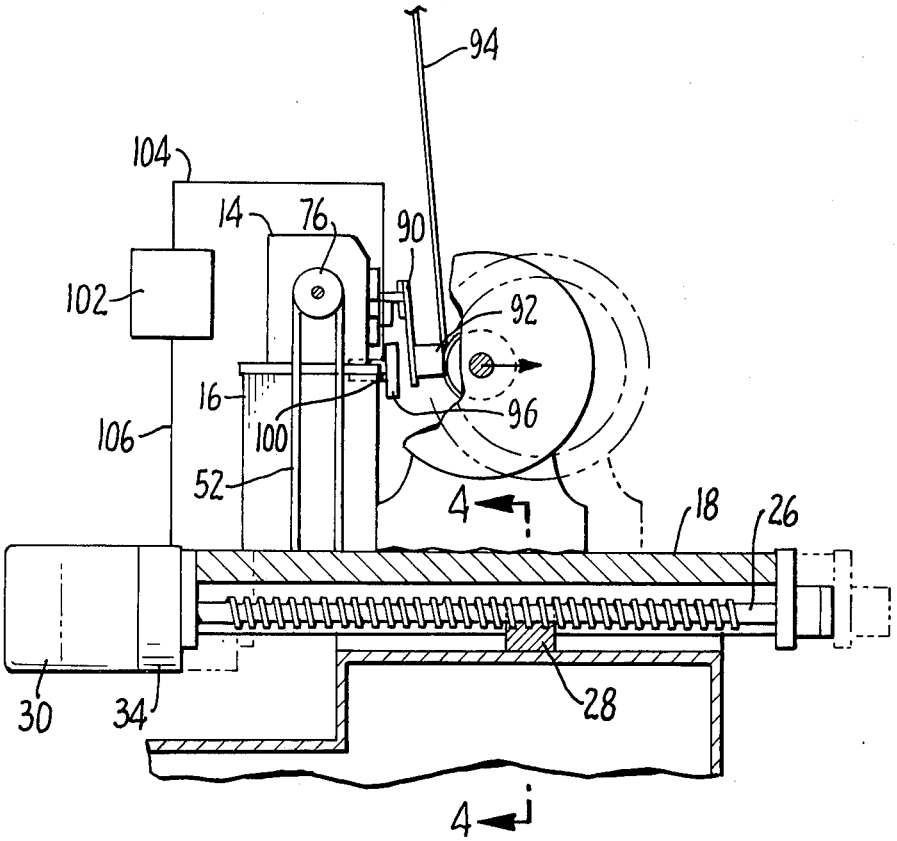
FIG. 3 is a cross-sectional elevational view taken on the plane designated by Line 3—3 of FIG. 1; and, FIG. 4 is a cross-sectional elevational view taken on the plane designated by Line 4—4 of FIG. 3.

The detection and time delay circuitry for the oscillator 100 is diagrammatically illustrated in FIG. 3 and designated by the numeral 102. As there shown, leads 104 and 106 extend, respectively, from the circuitry to the oscillator 100 and clutch 34. Oscillator detection circuits of the type which might be employed in the circuitry 102 are well known in the metal detector art. Time delay circuitry is also well known, as seen for example in aforementioned U.S. Pat. No. 3,897,021.

The winder of the present invention is also provided with limit switches to limit the extremities of forward and rearward movement of the table 18 and signal when a package on the collector 42 has grown to the maximum desired extent. The limit switches are mounted on the pedestal 12 and comprise forward motion limit switch 108, rearward motion limit switch 110 and alarm limit switch 112. A triggering stop 114 carried by the table 18 engages the switch 108 at the forward extremity of movement of the table 18 and a triggering stop 116 is carried by the table 18 for engagement with the limit switches 110 and 112. Engagement of the switches 108 and 110 occurs only during the course of movement of the table 18 by high speed operation of the motor 30 and functions to deactivate the highspeed operation of the motor and disengage the clutch 34. Engagement of the switch 112 normally occurs during the course of incremental movement of table 18 by the motor 30 and functions to trigger an alarm, such as a light and/or a bell to signal the completion of a full package.

At this point, it is noted that high-speed, reversible operation of the motor 30 is provided for the purpose of accelerating the spindle 38 toward or away from the traverse 14. Such accelerated movement is generally desired at the beginning and end of the formation of a package on the collector 42 of the spindle. At the beginning of such formation, the spindle is moved as close as possible to the traverse to facilitate start-up. At the end of the formation of such a package, the spindle is moved as far away from the traverse as possible to facilitate removal of the package.

FIG. 2 shows the aforedescribed embodiment wherein the guide block 92 slidably engages the peripheral surface of the package 44 and further illustrates the roving 94 in the process of being drawn from a bushing assembly 118 disposed at the undersurface of a forehearth 120. Preferably, the bushing 118 is of the high orifice density nontip disclosed in U.S. Pat. No. 3,905,790. The high output of such bushings ideally suits them for direct winding operation, as relatively large rovings are provided directly from the bushings. The structure shown in FIG. 2 is completed by a sizing applicator 122 and a gathering shoe 124.

FIG. 2A is similar to FIG. 2 and illustrates an alternative embodiment wherein the guide block, designated 92a, is held out of engagement with the peripheral surface of a package 44a by the tension in the strand being wound, designated 94a. The guide block 92a is held very close, but just off of the surface of the package 44a by the tautness of the strand 94a, thus allowing for precision placement of the strand without contacting the package with the guide. With this arrangement, as the package diameter slightly increases, the strand 94a pushes the block 92a slightly toward the traverse assembly.

The FIG. 2A embodiment also differs from the FIG. 2 embodiment in that the spring, designated 90a, comprises a non-metallic reinforced plastic strip. The guide block 92a is of a notched configuration similar to the block 92 and is held to the spring 90a by metallic screws 93.

The oscillator detector of the FIG. 2A embodiment is identical to that described above with respect to the FIG. 2 embodiment, with the exception that the oscillator triggering elements comprise the screws 93, rather than the spring 90. Upon depression of the spring 90a to a predetermined degree by the tautness of the strand 94a, the screws 93 enter the field of the oscillator and trigger the control circuitry to incrementally move the spindle away from the traverse. Thus, similar to the FIG. 2 embodiment, the FIG. 2A embodiment also maintains a substantially constant distance between the traverse and spindle.

FIGS. 2 and 2A also show the relative sizes of the collector 42 and the ultimate package formed on the collector and the angle, designated "*a*", which the roving strand 94 or 94a assumes relative to the outer surface of a package being formed on the collector. The solid line representation of the collector 42 depicts the commencement of the formation of a package and the phantom line representation of the collector 42 and the package thereon depicts the termination of the formation of a package. The arrow lines in FIGS. 2 and 2A show the rectilinear path through which the collectors move as the package grows. Because of the fixed position of the traverse 14, the angle *a* remains constant throughout this growth.

From FIGS. 2 and 2A, it can also be seen that a substantially constant angle, designated "*b*," is maintained around the gathering shoe 124. Maintaining the angle *b* constant functions to maintain a constant tension on the strand 94 and, thus, aids in keeping the edge of the package 44 square.

CONCLUSION

From the foregoing description, it is believed apparent that the present invention enables the attainment of the objects initially set forth therein. In particular, it provides a winder wherein the angle at which rovings are drawn to the peripheral surface of a package on the winder spindle is maintained constant and wherein undesired vibratory or wobbling movement between the spindle and the traverse is minimized.

It should be understood that the invention is not intended to be limited to the specifics of the illustrated embodiments, but rather is intended to embrace all variations coming within the scope of the accompanying claims.

What is claimed is:

1. A winder for directly drawing glass fiber from an orifice plate to form a precision wound package, said winder comprising: a traverse mounted in a fixed position, said traverse having a follower disposed for back and forth movement thereacross in a generally rectilinear path; a spindle disposed in parallel relationship to the rectilinear path of the follower; means mounting the spindle for rectilinear movement toward and away from the traverse while maintaining the relative parallel relationship of the spindle with the rectilinear path of the follower; a package engaging member mounted on the follower for engagement with the peripheral surface of a package of windings on the spindle and movement relative to the traverse in response to changes in the diameter of such a package; a metallic element mounted for movement with the package engaging member; an oscillator carried by the traverse to sense the position of the metallic element; and, motion imparting means coupled to the spindle to move the spindle on the mounting means therefor and away from the traverse, said motion imparting means being operatively associated with the oscillator to maintain a substantially constant distance between the peripheral surface of windings on the spindle and the traverse.

2. A winder, according to claim 1, wherein the oscillator is centrally disposed relative to the length of the traverse to sense the position of the metallic element when the element is disposed centrally of the traverse.

3. A winder for directly drawing glass fiber from an orifice plate to form a precision wound package, said winder comprising: a traverse mounted in a fixed position, said traverse having a follower disposed for back and forth movement thereacross in a generally rectilinear path; a spindle disposed in parallel relationship to the rectilinear path of the follower, said spindle being supported on a base member therefor; a track fixed against movement with the spindle and extending in a direction normal to the axis of the spindle; a track engaging member fixed to the base member of the spindle to mount the spindle for rectilinear movement toward and away from the traverse while maintaining the relative parallel relationship of the spindle with the rectilinear path of the follower; a screw carried by the spindle and extending parallel to the track; a nut fixed relative to the track and threadably engaged with the screw; an electric motor having a shaft driven for rotation thereby; an electrically operable clutch interposed between the screw and shaft to couple and uncouple the shaft and the screw; and, a sensor to sense the distance between the traverse and a package of windings on the spindle, said sensor being operatively associated with the clutch to activate the clutch in response to the sensed distance between the traverse and the peripheral surface of a package of windings on the spindle so as to maintain said distance substantially constant.

4. A winder, according to claim 3, further comprising:

a reversible high-speed electric motor having a shaft driven for rotation thereby and coupled in driving engagement with the screw;

means to selectively activate said motor to drive the screw to move the spindle toward or away from the traverse; and, limit switch means to automatically deactivate the said motor upon movement of the spindle to preselected positions relative to the traverse.

5. A winder for directly drawing glass fiber from an orifice plate to form a precision wound package, said winder comprising: a traverse mounted in a fixed position, said traverse having a follower disposed for back and forth movement thereacross in a generally rectilinear path; a spindle disposed in parallel relationship to the rectilinear path of the follower; means mounting the spindle for rectilinear movement toward and away from the traverse while maintaining the relative parallel relationship of the spindle with the rectilinear path of the follower; a strand engaging member disposed for engagement with a strand being drawn from the orifice plate and wound onto the spindle; means mounting the member so that the member is held out of engagement with the peripheral surface of the package by the tautness of the strand and is forced back by the strand as the package grows; a metallic element mounted for movement with the member; an oscillator carried by the traverse to sense the position of the metallic element; and, motion imparting means coupled to the spindle to move the spindle on the mounting means therefor and away from the traverse, said motion imparting means being operatively associated with the oscillator to maintain a substantially constant distance between the peripheral surface of windings on the spindle and the traverse.

6. A winder for directly drawing glass fiber from an orifice plate to form a precision wound package, said winder comprising: a traverse mounted in a fixed position, said traverse having a follower disposed for back and forth movement thereacross in a generally rectilinear path; a spindle disposed in parallel relationship to the rectilinear path of the follower, said spindle being supported on a base member therefor; a track fixed against movement with the spindle and extending in a direction normal to the axis of the spindle; means mounting the spindle for rectilinear movement toward and away from the traverse while maintaining the relative parallel relationship of the spindle with the rectilinear path of the follower; screw drive means coupled to the base member of the spindle to selectively move the spindle away from the traverse; and, a sensor to sense the distance between the traverse and a package of windings on the spindle, said sensor being operatively associated with the screw drive means to activate said means in response to the sensed distance between the traverse and the peripheral surface of a package of windings on the spindle so as to maintain said distance substantially constant.

7. In a winder for directly drawing glass fiber from an orifice plate and over a gathering shoe to form a precision wound package, said winder being of the type having: a traverse mounted in a fixed position and a follower disposed for back and forth movement thereacross in a generally rectilinear path; a spindle disposed in parallel relationship to the rectilinear path of the follower; means mounting the spindle for rectilinear movement toward and away from the traverse while maintaining the relative parallel relationship of the spindle with the rectilinear path of the follower; and, motion imparting means coupled to the spindle to selectively move the spindle on the mounting means therefor and away from the traverse; the improvement comprising: a strand engaging guide member carried by the follower for directly receiving a strand of glass fiber from the gathering shoe and guiding said strand onto the package being formed on the spindle without the interposition of intermediate strand engaging means between the gathering shoe and the guide member, said guide member being mounted for movement relative to the follower in response to the growth of a package on the spindle; control means responsive to movement of the guide member relative to the follower to control the motion imparting means so as to maintain a strand being drawn from the gathering shoe to the peripheral surface of a package of windings on the spindle at a substantially constant angle relative to the shoe.

8. In a winder according to claim 7, the improvement wherein the guide member is mounted for engagement with the peripheral surface of a package of windings on the spindle whereby growth of the package moves the member relative to the follower through contact of the member with the package.

9. In a winder according to claim 7, the improvement wherein the guide member is mounted for engagement with a strand being directed onto a package on the spindle so as to be moved relative to the follower by the tautness of the strand as the package grows, and without contact of the member with the package.

* * * * *